United States Patent [19]

Saulnier et al.

[11] Patent Number: 4,927,395

[45] Date of Patent: May 22, 1990

[54] COMBINED BUOY AND ANCHOR DEVICE

[75] Inventors: Kenneth D. Saulnier, P.O. Box 815, Yarmouth, Nova Scotia, Canada, B5A 4K4; Hubert J. Van Leeuwen, Amherst, Canada

[73] Assignee: Kenneth D. Saulnier, Yarmouth, Canada

[21] Appl. No.: 363,938

[22] Filed: Jun. 9, 1989

[51] Int. Cl.[5] ..... B63B 22/24

[52] U.S. Cl. ..... 441/26; 43/54.1; 114/300; 114/303; 206/315.11; 441/32

[58] Field of Search ..... 114/300, 303; 441/23, 441/24, 25, 26, 27, 32; 206/315.11; 43/54.1, 57.1, 21.2

[56] References Cited

U.S. PATENT DOCUMENTS

| | | | |
|---|---|---|---|
| 533,668 | 2/1985 | Reeves . | |
| 1,339,321 | 5/1920 | Crouch . | |
| 2,515,715 | 3/1948 | Jones | 9/17 |
| 2,722,190 | 11/1955 | Simshauser | 114/207 |
| 3,083,675 | 4/1963 | Rice | 114/210 |
| 3,111,693 | 11/1963 | Summers | 441/32 |
| 3,162,870 | 12/1964 | Laird | 441/25 |
| 3,182,340 | 5/1965 | Gentile | 441/32 |
| 3,212,110 | 10/1965 | Lombardo | 9/8 |
| 3,285,218 | 11/1966 | Gibertson | 114/207 |
| 3,441,962 | 5/1969 | Williams | 441/25 |
| 3,745,692 | 7/1973 | McGee | 43/21.2 |
| 3,754,525 | 8/1973 | Leighty | 114/206 R |
| 4,074,380 | 2/1978 | Parker | 9/8 R |
| 4,443,203 | 4/1984 | Maertens | 441/25 |
| 4,794,723 | 1/1989 | Arnold et al. | 43/54.1 |

FOREIGN PATENT DOCUMENTS

| | | |
|---|---|---|
| 69430 | 7/1921 | Canada . |
| 213730 | 10/1921 | Canada . |
| 449892 | 7/1948 | Canada . |
| 908514 | 8/1972 | Canada . |
| 1066568 | 11/1979 | Canada . |

*Primary Examiner*—Sherman D. Basinger
*Assistant Examiner*—Thomas J. Brahan
*Attorney, Agent, or Firm*—Beveridge, DeGrandi & Weilacher

[57] ABSTRACT

A combined buoy and anchor device for fishermen comprises a buoy body with a hollow interior and having its upper and closeable by a lid, a reel rotatably mounted in the buoy body and to which is secured the inner end of a cable, and an anchor connected to an outer end of the cable. The anchor includes a shank and a plate detachable from the shank, the plate and the lid having interengaging formations so that the plate can be retained in place on the lid. The buoy preferably includes a generally cylindrical upper portion surrounding the hollow interior, and a reel-containing lower portion separated from the upper portion by a wall. The hollow interior of the buoy can be used for holding bait or tackle.

7 Claims, 3 Drawing Sheets

COMBINED BUOY AND ANCHOR DEVICE

The present invention provides a combined buoy and anchor device for use by fishermen.

Many fishermen, when going fishing from a boat, carry an anchor, buoy, rope and a tackle box as separate items of equipment. This invention provides a combination device which makes it much easier to carry such equipment.

The anchor, which is of the mushroom type, is formed of two parts, namely a shank and a dished plate, the shank being detachable from the plate and adapted for storage close to the buoy body. The buoy body is made with a hollow interior for storage of bait or tackle. The buoy also carries the anchor cable.

In accordance with the invention, a combined buoy and anchor device for fishermen comprises a buoy body with a hollow interior and having a closure member for closing the upper end of said interior, a reel rotatably mounted in the buoy body and to which is secured the inner end of a cable, and an anchor connected to an outer end of the cable. The anchor plate is detachable from the shank part of the anchor and the plate and the closure member have interengaging means so that the plate can be retained in place on the closure, with the separated shank of the anchor being held close to the side of the buoy. The parts can thus be held together neatly for storage.

The invention will further be described with reference to the accompanying drawings, in which.

Figure 1:
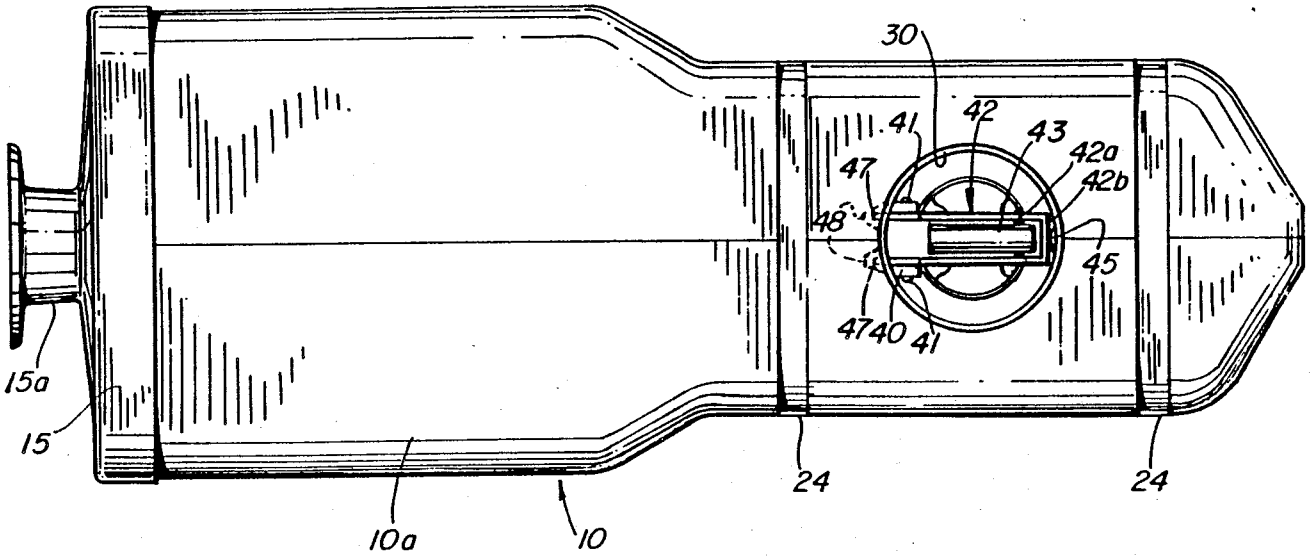
FIG. 1 shows a side view of the buoy alone (without the anchor parts)
Figure 2:
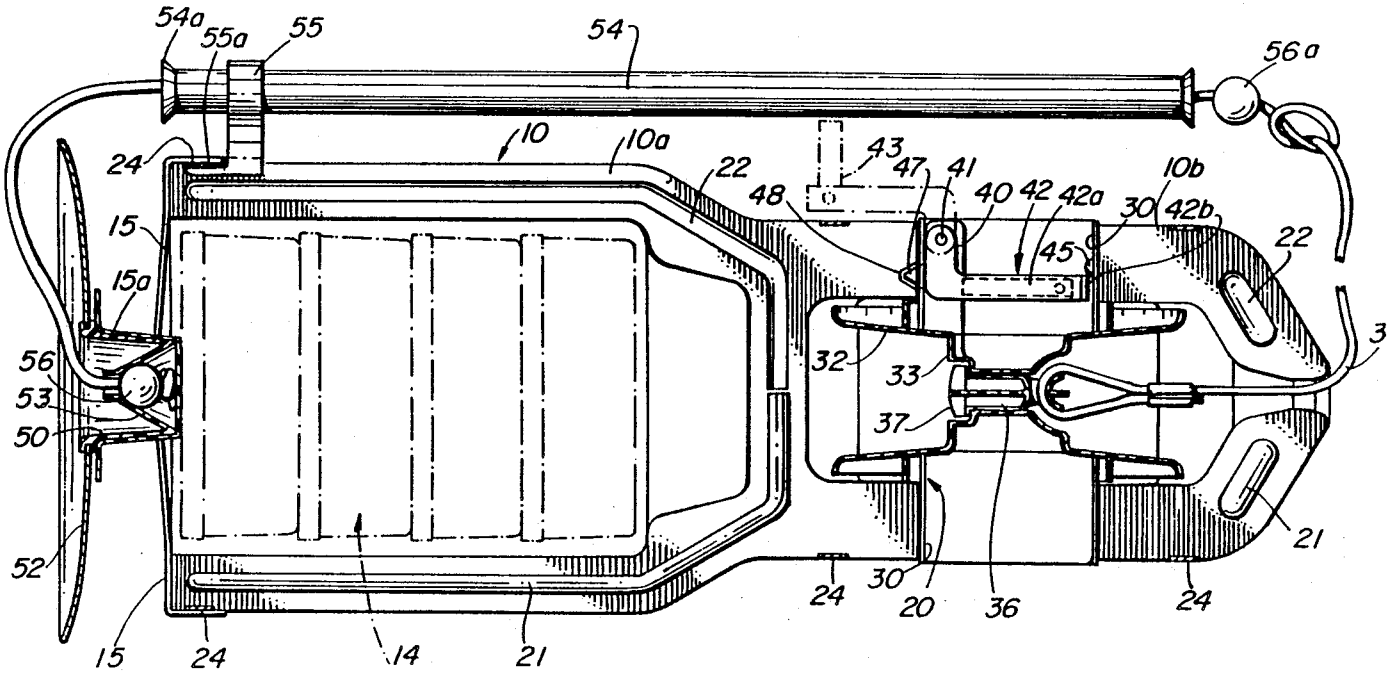
FIG. 2 shows a view of the combined buoy and anchor device in which the body part of the buoy is shown at the mating surfaces of a one-half molding of the buoy body, and in which the closure member, the anchor plate, and the reel are shown sectioned.

The buoy body 10 comprises two identical body halves, each of molded plastics material (preferably foamed plastics), one of which is shown at FIG. 2 with the mating surface exposed. The parts together define an upper generally cylindrical portion 10*a* having a hollow interior which may be used to hold bait or tackle, which may be contained within circular plastic boxes with snap-on lids indicated at 14, such as are generally available for food stuffs. The hollow interior of the buoy body is normally closed by a closure lid 15 having flanges which are a push bit onto the upper end of the buoy body. The hollow upper portion is separated by wall 16 from a lower portion 10*b* which holds a rotatable reel 20. The two body halves have interengaging lips 21 and grooves 22, and are held together by reinforced fiber glass tape applied as a band around three locations indicated at 24.

The reel 20 is molded of plastics material and comprises a hollow shaft part 30 and a central reel part with flanges 32 and a reduced diameter shaft part 33. An anchor cable 34 is connected to the center of the reel shaft 33 by a molded plastic eye bolt 36 having at one end an aperture to receive the cable and at the other end a head 37. This eye bolt is free to rotate in a transverse bore in the reel, to allow the buoy to rotate relative to the cable when this has been fully pulled off the reel thus preventing entanglement of the cable.

The outer part of shaft 30 is provided with internal ribs 40 which are spaced on each side of a central diametral plane and which are parallel to this plane. These ribs have opposed bores which provide bearings for spigots 41 projecting from a base part of a handle member 42. This handle member has two L-shaped side portions 42*a* connected by a bridging piece 42*b* at the end opposite the base part, the handle member 42 having sufficient resiliency to allow the spigots to be snapped into the bearings in ribs 40. Just below the bridging piece is a pivotable handle 43 which can be moved between a recessed position between the side portions and an outwardly projecting position shown in broken lines in FIG. 2, where the handle parts are extended to allow the handle to rotate the reel and to wind in the anchor cable. When the handle parts are in the folded position shown in full lines in FIG. 2 the handle is contained wholly within the shaft 30. Part 43 is held in folded condition by friction.

The handle 42 is releasably retained in the folded condition by a projection 45 formed in the reel shaft 30. In this condition, stop pins 47 which are extensions of side portions 42*a* engage in cavities 48 in the buoyant material of the buoy to prevent rotation of the reel.

Figure 3:
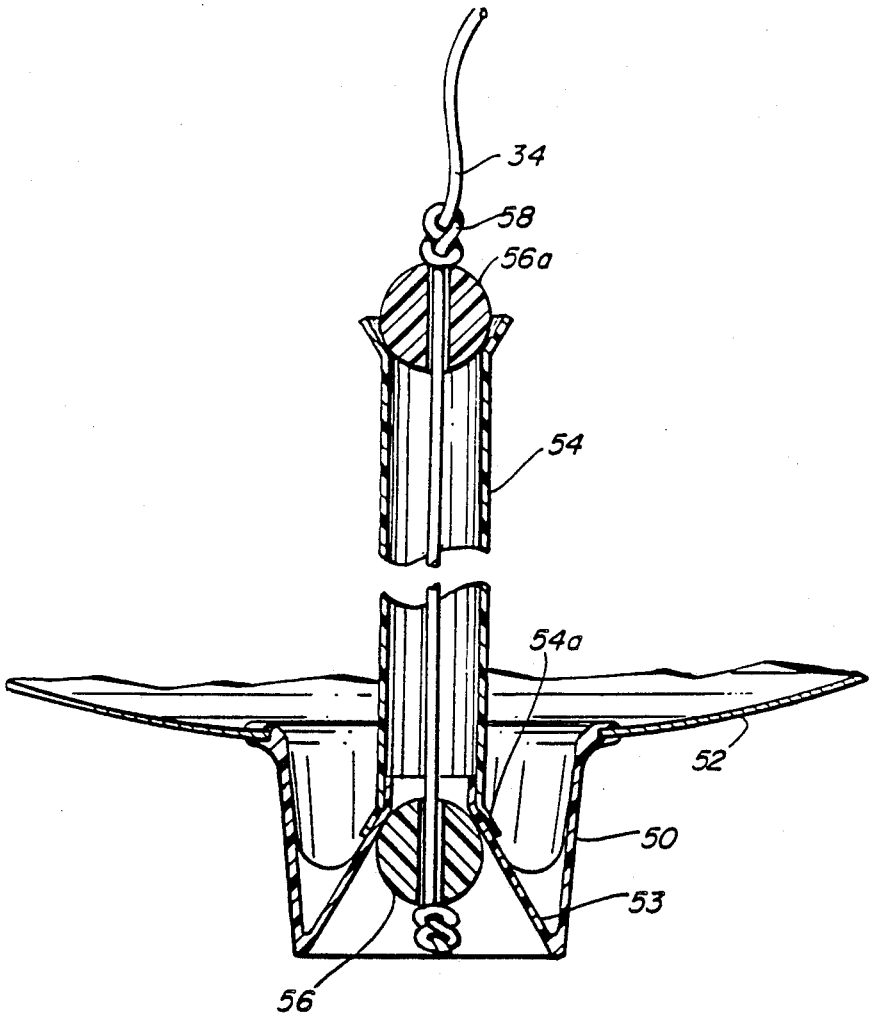
FIG. 3 shows a view of the anchor as assembled.

The removable closure lid 15 is a circular type push-on lid, which is specially adapted for holding the plate part of the anchor. For this purpose the lid 15 has a central boss 15*a* defining an inwardly tapered socket, and this receives a correspondingly shaped frusto-conical projection 50 which is fixed to a dished anchor plate 52, these parts having matching conical surfaces which allow the anchor plate to be held in place by friction when positioned as shown in FIG. 2. The frusto-conical projection 50 surrounds an inner conical projection 53 of opposite taper, designed to mate with an outwardly flared end formation 54*a* of a tubular anchor shaft 54, in the manner shown in FIG. 3. The cable 34 passes through the center of shaft 54 and through the conical projection 53, and terminates in a ball part 56 held by a knot at the end of the cable. A similar ball member 56*a* is provided on the part of the cable extending from the upper end of anchor shaft 54. When it is desired to assemble the anchor as shown in FIG. 3 the anchor plate is removed from the lid and positioned relative to the shaft 54 as shown in FIG. 3, the cable is pulled tight so that ball 56 holds the parts together, ball 56*a* is pushed against the upper end of the shaft and is then held in place by a knot shown at 58 in FIG. 3. Cable 34 has sufficient elasticity to hold the parts together. The anchor parts are preferably made of aluminum.

As shown in FIG. 3, the parts may be stowed with the plates 52 retained by lid 15, and with the anchor shaft 54 held along side the buoy body. For this purpose the upper part of the buoy body is provided with a holding clip 55 having resilient fingers which define an opening into a recess for holding the shaft 54, and having a foot 55*a* held in place in a recess in the buoy body by the tape 24 which passes over this foot.

In use, the fisherman would remove the tackle boxes and anchor parts from the buoy, assemble the anchor and set this by running a suitable length of cable from the reel by folding out the handle and allowing the reel to rotate. The handle would then be folded inside the reel shaft to lock the reel, and the fisherman would then attach his boat by a short rope to the anchor cable just under the buoy.

We claim:

1. A combined buoy and anchor device for fishermen, comprising:

(a) a buoy body with a hollow interior, and having a closure member for closing its upper end, (b) a reel rotatably mounted in the buoy body and to which is secured the inner end of a cable, (c) an anchor connected to an outer end of said cable, said anchor including a shank and a plate detachable from said shank, and wherein said plate and said closure member have interengaging means whereby said plate can be retained in place on said closure member.

2. The device of claim 1 wherein said closure member has a central boss defining an inwardly tapered socket, and wherein said anchor plate has a central frustoconical projection having a taper matching that of said socket when the plate is detached from the shank.

3. The device of claim 2 wherein said frustoconical projection surrounds an inner conical projection of opposite taper, and wherein said anchor shank is tubular and has an outwardly flared end formation at an inner end capable of mating with the outside of said inner conical projection; said cable passing through said anchor shank and said inner projection, and wherein the cable carries means abutting the inside of said inner projection and the outer end of the shank, and capable of applying compressive force between the outer end of the shank and the inner projection whereby the cable can hold the anchor parts together.

4. The device of claim 3 wherein the buoy body includes an upper generally cylindrical portion surrounding the hollow interior and a reel-containing lower portion separated from the upper portion by a wall.

5. The device of claim 2 wherein the buoy body includes an upper generally cylindrical portion surrounding the hollow interior and a reel-containing lower portion separated from the upper portion by a wall.

6. The device of claim 1 wherein the buoy body includes an upper generally cylindrical portion surrounding the hollow interior and a reel-containing lower portion separated from the upper portion by a wall.

7. The device of claim 1 wherein said reel has a hollow shaft portion with internal ribs, between which ribs is held a handle for rotating the reel, the connection between the ribs and handle allowing the handle to be folded within the outer end of the hollow shaft.

* * * * *